United States Patent [19]

Deininger

[11] Patent Number: 4,522,566

[45] Date of Patent: Jun. 11, 1985

[54] ADJUSTABLE AXIAL PISTON PUMPS WITH REGLATING UNITS AND REGULATING UNITS FOR THE SAME

[75] Inventor: Horst Deininger, Horstein-Alzenau, Fed. Rep. of Germany

[73] Assignee: Linde Aktiengesellschaft, Wiesbaden, Fed. Rep. of Germany

[21] Appl. No.: 478,066

[22] Filed: Mar. 23, 1983

[30] Foreign Application Priority Data

Feb. 3, 1983 [DE] Fed. Rep. of Germany ..... 3211307

[51] Int. Cl.[3] ..... F04B 1/26

[52] U.S. Cl. ..... 417/222; 60/450

[58] Field of Search ..... 60/445, 450, 452; 417/218, 222

[56] References Cited

U.S. PATENT DOCUMENTS 3,444,689 5/1969 Budzich ..... 60/450 X
3,732,041 5/1973 Beal et al. ..... 417/222
4,116,587 9/1978 Liesener ..... 60/445 X
4,355,510 10/1982 Ruseff ..... 417/222 X

*Primary Examiner*—Edward K. Look
*Attorney, Agent, or Firm*—Buell, Ziesenheim, Beck & Alstadt

[57] ABSTRACT

An axial piston pump capable fo swinging out to one side from the zero-stroke position is provided in which a force acting in the direction to the zero-stroke position engages on one side of a final control element and a spring force acting in the direction to the maximum stroke position engages on the other side, and the force acting in the direction to the zero-stroke position is produced by an operating cylinder-servo piston unit, whose servo piston is connected with the control bottom of the pump and a regulating unit is located in the servo piston in order to faciitate a minimal structural volume and cost, where this regulating unit preferably has two springs, one of which is supported against the housing and the second is supported against an auxiliary piston that is acted upon by the pressure beyond a restrictor in the delivery line.

12 Claims, 1 Drawing Figure

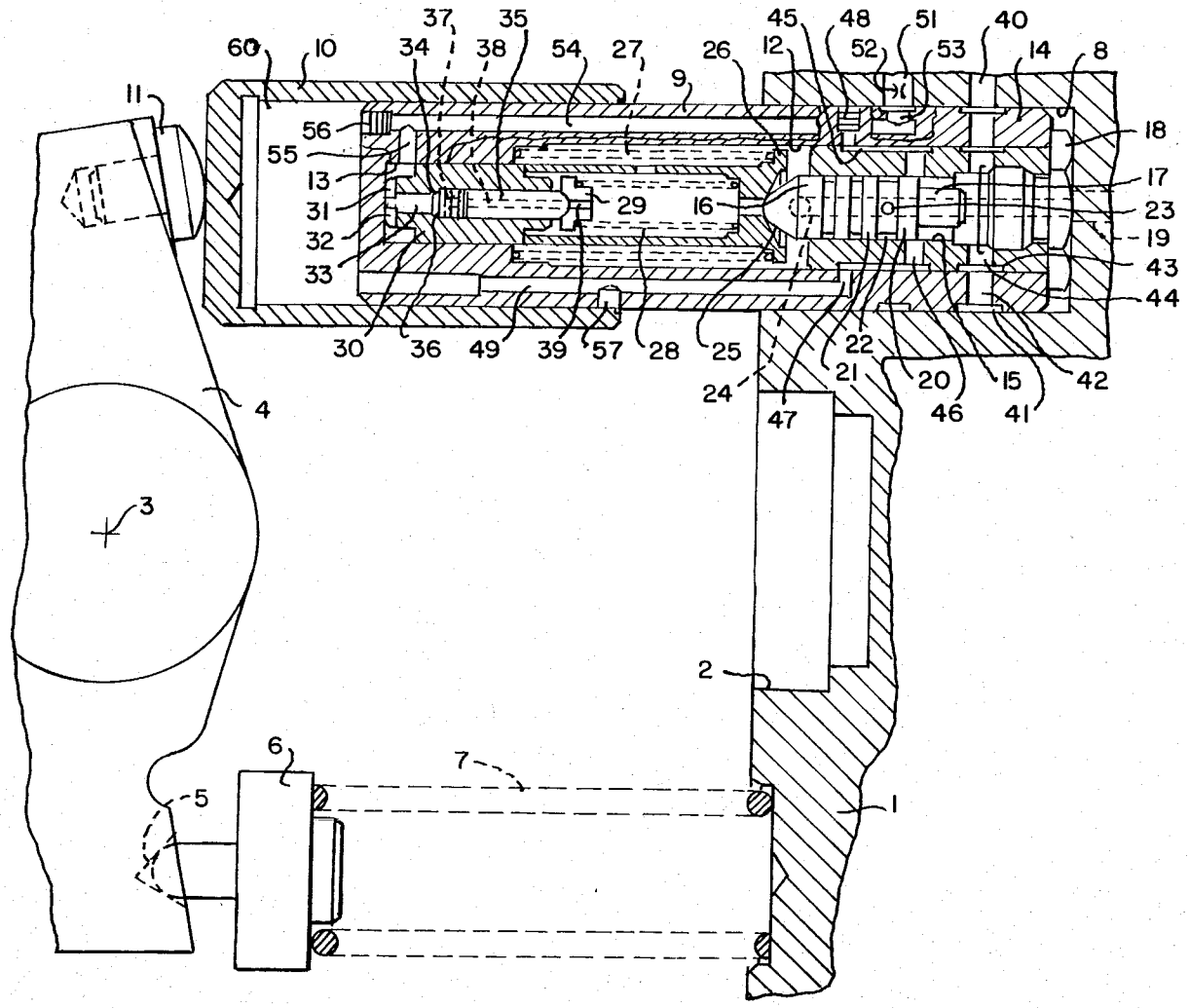
18
17
23
19
43
44
8
42
14
41
40
15
53
46
51
20
52
22
48
21
45
47
12
1
26
24
25
2
16
9
28
27
29
57
54
39
35
49
38
7
37
36
34
30
10
56
13
31
32
33
55
6
60
4
5
11
3

ADJUSTABLE AXIAL PISTON PUMPS WITH REGLATING UNITS AND REGULATING UNITS FOR THE SAME

This invention relates to adjustable axial piston pumps with regulator units and regulating units therefore and particularly to an axial piston pump capable of being adjusted in one direction out from the zero stroke position, preferably in swash plate construction, with a swivellable final control element, on which a force acting in the direction to the zero-stroke position engages on one side of the swivel axis and a force acting in the direction to the maximum stroke position engages on the other side of the swivel axis, in which case the elements producing the forces are at least approximately parallel to the axis of rotation of the cylindrical drum and where a force is produced by a cylinder-piston unit with a section capable of being adjusted in the control bottom (housing lid) of the axial piston pump, the said section receiving the regulating element. The invention also concerns the design of a regulating element that is suitable for such a design of the axial piston pump and is attuned to it.

In one variant of the axial piston machine corresponding to the invention, an insert section is provided in a laterally elongated part of the housing bottom, against which the cylindrical drum lies directly or indirectly and in which the channels for feeding and/or at least removal from the cylindrical drum are located, parallel to the axis of rotation of the cylindrical drum. This insert section projects out from the control bottom with a spring-receiving section on the side facing away from the cylindrical drum and in it a regulating unit is located, in which case a cylinder-piston unit is located in the extension of this insert section, which receives the regulating unit. The piston of this cylinder-piston unit lies against the final control element of the pump and acts on it in the direction from the zero-stroke position out to the maximum outswing. On the other side of the swivel axis, a second insert section with a cylinder-piston unit connected to it is provided, parallel to the first insert section in a corresponding bore hole of a second extension of the control bottom; in this case, the piston of the cylinder-piston unit acts on the final control element in the direction of its zero-stroke position. The two insert sections are interchangeable with each other here (U.S. Pat. No. 3,830,594). This construction requires a large space and considerable constructional expense.

The invention proposes an axial piston pump with regulating unit for a combined pressure regulation and delivery stream regulation, suitable for required stream regulation, with small external dimensions and which can be produced at low cost.

According to the invention, this problem is solved in that the regulating unit is integrated (built in) into the piston of the operating cylinder-servo piston unit or designed in a particular manner. According to the invention, the operating cylinder-servo piston unit is the element that produces the force acting in the direction to the zero-stroke position, in which case the cylinder is the moveable part that collaborates with the final control element and the piston is connected solidly with the control bottom or housing lid of the axial piston machine, where the force acting in the direction to the maximum stroke position is produced by means of a spring.

A regulating unit especially suited, but not only, for an axial piston pump according to the invention is a regulating unit for a hydrostatic pump that is adjustable in one directon out from the zero-stroke position, of the variety (which is known by a company publication "Konstantstromregler 892402" [constant stream regulator]) which is provided with a valve piston that is capable of sliding against the force of two springs, one of which is supported against the housing and the other is supported against an auxiliary piston that is acted upon by pressure, and controls the inflow and outflow to and from a space in front of the end face of the servo piston, one face of this valve piston being acted upon by the delivery pressure of the pump, in which case according to the invention a second pressure connection is provided at the regulating unit and it is acted upon by the pressure in the delivery line of the pump in the direction of flow beyond a restrictor, preferably an arbitrarily adjustable restrictor, and is connected with the space in front of the end face of the auxiliary piston. Regulating and control equipment for adjustable pumps, where an adjustable restrictor is provided in the delivery line of the pump and the pressure in front of and beyond this restrictor acts on a valve controlling the inflow and outflow of an operating cylinder-servo piston unit, are known in themselves (DE-AS 23 50 390). These devices are designed so that a certain pressure gradient, which is sufficient for control, but otherwise is as small as possible, is always maintained at the restrictor, so that the size of the delivery stream, to which the pump is adjusted, can be arbitrarily determined by adjusting the opening of the restrictor and thus the pressure gradient in the case of a certain delivery stream. According to the invention, such a control is thus integrated into the regulating unit and thus, in the arrangement according to the invention, in the servo piston.

In a particularly advantageous implementation, an additional piston supported against a spring is provided; this is designed as part of an additional piston valve that opens when the closure element slides against the force of this spring, and in the open state connects the space in front of the end face of the auxiliary piston with a drain line.

This further refinement is in turn expediently designed so that the additional piston valve is located in the auxiliary piston and that the spring, against which the additional piston is supported, is the second spring supported against the valve piston.

As in the known state of the art, an inflow restrictor is located in the line carrying the pressure in the delivery line beyond the restrictor according to a design essential to the invention in order to prevent an inadmissibly large stream to flow out of the delivery line of the pump when the additional pump valve is opened. However, one primary purpose is to assure with this inflow restrictor that there is not an unlimited flow of fluid out from the delivery line when the additional piston valve is opened, but that this stream is throttled by the inflow restrictor so that the pressure in front of the auxiliary piston definitely drops when the additional piston valve is opened.

In one expedient implementation, the additional piston valve is designed as a seat valve, preferably as a cone seat valve.

According to an additional implementation, the valve piston is supported against a spring plate, against which two springs are supported, and which is preferably supported against the auxiliary piston by means of a sleeve.

The regulating unit located in the housing-fast servo piston is designed in a particularly advantageous implementation form so that it is parallel to the axis of the servo piston, in which case the connections at the delivery line and the connection at the drain line are located in the region of the servo piston end on the housing side, where the valve piston also lies in this region of the servo piston, and a longitudinal channel emptying in front of the end face of the servo piston and a second longitudinal channel emptying into the space in front of the end face of the auxiliary piston are located in the servo piston.

Depending on the structural and production circumstances, it may be expedient to produce these longtiudinal channels by giving the servo piston a central section, over which a socket is tightly drawn, in which case the longitudinal channels are formed by flattened zones or grooves in the central section, so that the walls of the longitudinal channels are formed on the one hand by the surfaces of the flattened areas and also by the overlying portion of the inner wall of the socket.

In the foregoing general description of this invention I have set out certain objects, purposes and advantages of the invention. Other objects, purposes and advantages of this invention will be apparent from a consideration of the following description and the accompanying drawings in which:

The single FIGURE shows an embodiment of the regulating unit of this invention in longtitudinal section in connection with a fragmentary portion of an axial piston pump showing only those parts which are essential to an understanding of the invention.

Referring to the drawing, I have illustrated a control bottom 1 forming a part of an axial piston machine housing (otherwise not shown) and is designed as a control bottom receiver insofar as it has a recess 2 in which a conventional control plate (not shown in the drawing) is supported, against which a conventional cylindrical drum (not shown) lies, where the control plate has two channels that carry the working fluid to and from the cylindrical drum, in which case these channels continue in the control bottom 1 in a manner not shown in the drawing but conventional in construction.

The rocking part 4 is supported swivellably around the swivel axis 3 by means of conventional bearing (not shown) in the housing (not shown); it has a recess 5 on one side, in which a spring plate 6 is supported, against which a spring 7 is supported, which is supported at its other end against the control bottom 1. The axis of rotation of the cylindrical drum (not shown) passes through the swivel axis 3 and the axis of the recess 2.

A bore hole 8 is located in the control bottom 1 on the side of the cylindrical drum axis opposite the spring 7 and the swivel axis 3. The servo piston 9 is inserted into the bore hole 8; the operating cylinder 10 is capable of sliding tightly on its cylindrical outer surface and it lies with its end face against a thrust bearing 11, which is inserted into the rocking part 4.

The servo piston 9 has a central bore hole 12, to which a bore hole 13 of smaller dimension connects in the face side section.

For production reasons, a gate valve body 14 is inserted into the bore hole 12 and in turn it has a bore hole 15 that has the same diameter as the bore hole 13 and which is arranged at least approximately coaxially to it. A valve piston 16 is supported in the bore hole 15 in a longitudinally slidable manner and it has a detent 17 that can be brought to lie against a stop 18, which is screwed with its threads into the gate valve body 14 and whose head surface simultaneously fixes the gate valve body 14 opposite the servo piston 9. The inner space of the bore hole 12 is connected by means of a bore hole 19 with a drain line of conventional form (not shown).

A valve plate 26 is supported against the end surface section 25 of the valve piston 16 and against it a spring 27 is supported, which on the other side is supported against the servo piston 9 and against which a second spring 28 is supported, which on the other side is supported against a valve plate 29.

An auxiliary piston 30 is capable of sliding tightly in the bore hole 13; its front wall section 31 is tapered and thus forms an annular space around itself in the bore hole 13. This annular space is connected through the milled out sections 32 with the longitudinal bore hole 33, which passes into a bore hole **33*a* of larger diameter at one edge of conical bore 34. An additional piston 35 is capable of sliding in the larger bore hole 33*a*; it is tapered in the left-hand section in the drawing and runs out in a tapered valve cone 26, which can lie in a sealing manner against the conical bore 34. A transverse bore hole 37 is located in the tapered section of valve core 36 and it goes over into a longitudinal bore hole 38, which empties in the inner space of bore hole 12 through a bore hole 39 in the spring plate 29**.

The additional piston 35 lies with the conical surface of valve core 36 against the edge 34. The borehole 33 located to the left from this edge 34 in the drawing has a smaller diameter than the borehole **33*a* connected to the right of it. The part of the additional piston 35 that connects to the tapered valve core 36 that lies against the tapered edge 34 is smaller in diameter than the main part of the additional piston 35, which slides in a sealing manner in the borehole 33*a* and which has a larger diameter than the borehole 33. The additional piston 35 can move against the force of the spring 28 so that the tapered valve core 36 of the additional piston 35 moves away from the tapered conical bore 34, with the result that the oil, which is under pressure in the borehole 33, can flow through between the valve cone 36 and the tapered conical bore 34 into the borehole 33*a*. Since the part of the additional piston 35 connecting to the valve cone 36 has a smaller diameter than the borehole 33*a*, the oil can flow past tapered concial bore 34 at this tapered valve core on the additional piston 35, so that the oil gets into the transverse boreholes 37. The additional piston 35 has its full diameter only beyond the transverse boreholes 37, which can be seen at the edge indicated in the drawing. From the transverse borehole 37 the oil flows into the longitudinal borehole 38 and from the latter into the inner chamber of the borehole 12, which is connected with the drain hole 19** (see also the German priority document date, p. 11, lines 11 and 12).

A bore hole 40 is provided in the control bottom 1; it is connected in a manner not shown in the drawing inside of the control bottom 1 with the delivery line connection of the pump and it empties into an annular groove 41 in the servo piston 9, into which the bore holes 42 located in the servo piston 9 also empty. An annular groove 43 in the gate valve body 14 lies opposite the mouths of these bore holes 42 and from it the bore holes 44 empty into the inner space of the bore hole 15.

An annular groove 45 is also provided in the gate valve body 14; it is connected through bore holes 46 with the inner space of the bore hole 15 and from it a sack bore hole 47 passes out, which is also closed by a stopper 48 and empties into a longitudinal channel 49 in the servo piston 9, which in turn empties in the end face of the servo piston 9.

A bore hole 51 is also provided in the control bottom 1; it is connected in a manner (not shown) with the delivery line of the pump in the direction of flow beyond a restrictor (not shown). An inflow restrictor 52 is located in the bore hole 51. Opposite the bore hole 51 in the control bottom 1, there is a bore hole 53 in the servo piston 9, which empties into a longitudinal bore hole 54 in the servo piston 9, which is closed by a stopper 56 and into which a transverse bore hole 55 empties, which empties into the inner space of bore hole 13.

A transverse bore hole 57 is also provided in the servo piston 9; it empties into the longitudinal channel 49 on the one hand and at the surface of the servo piston 9, on the other, in a region that is covered in every other position of the operating cylinder 10 except in the case of an extreme position of the rocking part 4 and thus the operating cylinder 10.

The spring plate 26 is provided with a sleeve-like extension 58 that is supported against the auxiliary piston 31 and which has at least one transverse bore hole that serves to connect the inner space of the extension sleeve 58, even if it is lying against the auxiliary piston 30, with the inner space of the bore hole 12.

The mode of operation is as follows: If the delivery pressure of the pump present in the bore hole 14 increases, the force produced by this delivery pressure on the right-hand side of the valve piston 16 in tne drawing also increases, such that the valve piston 16 is displaced toward the left in the drawing against the force of spring 27 and thus effects a connection with its edge section 20 between the portion of the inner space of bore hole 15 connected with the bore hole 40 and lying to the right of it in the drawing, through the bore hole 46 and the annular space 45 and the bore hole 47, with the longitudinal channel 49, so that pressure medium flows by this route into the inner space 60 of the operating cylinder 10, such that the latter is shifted to the left in the drawing and thus reduces the stroke of the pump until the delivery pressure has decreased enough so that the force of the spring 27 moves the valve piston 16 far enough to the right in the drawing so that the edge section 20 of bore hole 46 is closed. If the delivery pressure drops, the force of the spring 27 displaces the valve piston 16 to the right in the drawing and connects the bore hole 46 through the annular groove 22 with the bore hole 23 and through the bore hole 24 and the inner space of the bore hole 12 and thus with the pressureless drain line 19, so that pressure medium is passed out through the latter from the space 60 in front of the end face of the servo piston 9 and the operating cylinder 10 is thus displaced to the right in the drawing.

So long as the pressure beyond the restrictor in the delivery line of the pump is less by the stipulated amount than the pressure in front of this restrictor, i.e., by the amount to which the spring 28 is designed, the auxiliary piston 30 is displaced jointly with the valve piston 16. If the pressure beyond the restrictor increases relatively as a result of an excessively small delivery stream, the pressure acting on the end face of the additional piston 35 is capable of displacing it to the right in the drawing against the force of the spring 28 so that the valve cone 36 is lifted from the edge 34 and thus produces a connection between the space in front of the end face of the auxiliary piston 30 (on the left in the drawing) with the inner space of the bore hole 12, which is connected through the line 19 with the drain line, so that the space in front of the end face of the auxiliary piston 30 (on the left in the drawing) is relieved of pressure, with the result that the auxiliary piston 30 is displaced to the left in the drawing under the action of the spring 28. The force of spring 28, against which the valve piston 16 is also supported through the spring plate 26, thus becomes less. On the other hand, if the pressure in the delivery line beyond the restrictor decreases in comparison to the pressure in front of the restrictor due to an excessively large delivery stream, the pressure in front of the end face of the auxiliary piston 13 to the left in the drawing also drops, so that it drops back to the left in the drawing and thus relieves the spring 28 and thus the force acting on the left-hand side of the valve piston 16 decreases.

In the foregoing specification, I have set out certain preferred practices and embodiments of my invention, however, it will be understood that this invention may be otherwise embodied within the scope of the following claims.

I claim:

1. In an axial piston pump having a piston unit, a control bottom adjacent said piston unit, a swivellable final control element spaced from the control bottom, said control element being capable of being swung out in one direction around a swivel axis from the zero-stroke position and on which a first force acting in the direction of the zero-stroke position engages on one side of the swivel axis and a second force acting in the direction to the maximum stroke position engages on the other side of the swivel axis, means producing the said first and second forces arranged at least approximately parallel to the axis of rotation of a cylindrical drum, the improvement comprising a section of said piston unit adjustable in the control bottom of the axial piston pump, a regulating unit in said section, an operating cylinder-servo piston unit connected to said final control element producing the force acting in the direction to the zero-stroke position, said regulating unit being built into the servo piston, said piston in turn being connected with the control bottom, wherein the operating cylinder of the piston unit acts together with the final control element and a spring acting in the direction to the maximum stroke position producing a change in position of the final control element.

2. An axial piston pump in accordance with claim 1 having a valve piston capable of sliding against the force of a spring supported against the control bottom and controlling the inlet and outlet to and from a space in front of the end surface of the servo piston, one face of this valve piston being acted upon by the delivery pressure of a fluid pump and against which a second spring acting parallel to the first spring, is supported and also against an auxiliary piston, a second pressure connection provided at the regulating unit and acted upon by the pressure in the delivery line of the pump beyond an arbitrarily adjustable restrictor and connected with the space in front of the front face of the auxiliary piston.

3. An axial piston pump according to claim 2, in which an additional piston supported against the force of a spring is provided, said additional piston designed as a part of an additional piston valve that opens when sliding against the force of said spring and in the open state connects the space in front of the front face of the auxiliary piston with a discharge line.

4. An axial piston pump according to claim 3, in which the additional piston valve is located in the auxiliary piston and that the spring, against which the additional piston is supported, is the second spring supported against the valve piston.

5. An axial piston pump according to claim 4, wherein the additional piston is supported against the auxiliary piston in the closed position of the additional piston valve.

6. An axial piston pump according to claim 4, wherein the additional piston valve is designed as a seat valve.

7. An axial piston pump according to claim 2, wherein the valve piston is supported against a spring plate, against which both first and second springs are supported.

8. An axial piston pump according to claim 7, wherein the spring plate is supported against the auxiliary piston by means of an extension sleeve.

9. An axial piston pump in accordance with claim 1 or 2, wherein the regulating unit is positioned parallel to the axis of the servo piston and that first and second connections are located on the delivery line and a third connection is located on the discharge line and the valve piston in the region of the servo piston end on the control bottom side and a first longitudinal channel that empties in front of the end face of the servo piston and a second longitudinal channel emptying in the space in front of the end face of the auxiliary piston are located in the servo piston.

10. An axial piston pump according to claim 2, wherein an inflow restrictor is located in the line carrying the pressure in the delivery line beyond the restrictor.

11. An axial piston pump according to claim 2, wherein the servo piston has a central section over which a socket is placed, in which case the longitudinal channels are formed by flattened zones on the central section.

12. An axial piston pump according to claim 9, wherein the servo piston has a central section over which a socket is placed, in which case the longitudinal channels are formed by flattened zones on the central section.

* * * * *

UNITED STATES PATENT AND TRADEMARK OFFICE

CERTIFICATE OF CORRECTION

PATENT NO. : 4,522,566

DATED : June 11, 1985

INVENTOR(S) : HORST DEININGER

It is certified that error appears in the above-identified patent and that said Letters Patent is hereby corrected as shown below:

In the Title of the Invention, "Reglating" should read --Regulating--.

Column 4, line 22, change "26" to --36--.

Column 4, line 46, change "concial" to --conical--.

Column 4, line 55, change "date" to --data--.

Signed and Sealed this

*Eleventh* Day of *February 1986*

[SEAL]

*Attest:*

DONALD J. QUIGG

*Attesting Officer*

*Commissioner of Patents and Trademarks*